US006375429B1

(12) United States Patent
Halila et al.

(10) Patent No.: US 6,375,429 B1
(45) Date of Patent: Apr. 23, 2002

(54) TURBOMACHINE BLADE-TO-ROTOR SEALING ARRANGEMENT

(75) Inventors: Herbert Halila, Boynton Beach, FL (US); Douglas Paul Beneteau, Fairfield, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/777,166

(22) Filed: Feb. 5, 2001

(51) Int. Cl.[7] ..... F01D 5/22
(52) U.S. Cl. ..... 416/193 A; 416/248
(58) Field of Search ..... 416/190, 193 A, 416/220 R, 248; 415/136, 138; 277/641

(56) References Cited

U.S. PATENT DOCUMENTS 4,021,138 A * 5/1977 Scalzo et al. ..... 416/95
4,432,555 A * 2/1984 Langley ..... 277/25
4,500,098 A * 2/1985 Wilcox et al. ..... 277/170
4,878,811 A * 11/1989 Jorgensen ..... 416/215
5,078,576 A 1/1992 Hayton ..... 415/209.3
5,211,536 A 5/1993 Ackerman et al. ..... 415/177
5,472,313 A 12/1995 Quinones et al. ..... 415/115
5,622,475 A 4/1997 Hayner et al. ..... 416/220 R
5,685,158 A 11/1997 Lenahan et al. ..... 60/726

* cited by examiner

*Primary Examiner*—Edward K. Look
*Assistant Examiner*—Ninh Nguyen
(74) *Attorney, Agent, or Firm*—Nathan D. Herkamp; Alfred J. Manigels

(57) ABSTRACT

A turbomachine rotor blade having a dovetail-type base member, a platform carried by the base member, and an airfoil extending longitudinally from the platform in a direction opposite to that of the base member. The platform includes a forward seal wire groove and an aft seal wire groove, each of which is on opposite sides of the blade longitudinal axis and on the side of the platform facing the base member. The blade platform has a pair of recesses that each include a concave portion and an adjacent inclined ramp portion for urging a seal wire into surface-to-surface contact with the concave portions of the respective recesses. Wear of the blade platform caused by seal wire movement relative to the blade platform is significantly reduced.

20 Claims, 4 Drawing Sheets

TURBOMACHINE BLADE-TO-ROTOR SEALING ARRANGEMENT

BACKGROUND OF THE INVENTION

The present invention relates to sealing arrangements in axial-flow turbomachines to minimize leakage of gases. More particularly, the present invention relates to a sealing arrangement between a turbomachine rotor blade and a rotor disk to minimize cross-stage leakage flow between the blade and the rotor.

Modern gas turbine engines generally include an axial-flow compressor and an axial-flow turbine, among other components. Each of the compressor and turbine includes one or more rotor disks, and each rotor disk carries a plurality of peripherally-positioned, circumferentially-spaced rotor blades. The rotor blades in a compressor are adapted to act on incoming air to increase its pressure by compressing it, and the rotor blades in a turbine are adapted to be driven by hot combustion products, and in the process they take energy from the combustion products. In each case, however, there is a pressure differential across the rotor blade in the axial direction of the gas flow, and consequently there is the possibility of undesirable leakage flow that can take place between the upstream and downstream portions of the rotor.

One such possible leakage path exists at the interconnection between the rotor blades and the rotor disk, where there is a small gap between the blade base member, usually a dovetail design, and the rotor disk groove in which the rotor blades are carried. Accordingly, in some gas turbine engines small diameter seal wires are employed and are positioned between the blade platform and the outer periphery of the rotor disk in an effort to seal the upstream and downstream areas at the connections between the rotor blades and the rotor disks to thereby block leakage flow. The seal wires are split and can therefore expand in a radial direction of the rotor when under the influence of centrifugal force. Such seal wires serve to minimize leakage gas flow from the high-pressure region of the flow path to the low-pressure region, and thereby maintain the maximum mass flow of the gas flow stream to maintain the operating efficiency of the engine.

The various rotating parts of a gas turbine engine are subjected to centrifugal loads during engine operation. Such centrifugal loads can be continuous loads and they can also be alternating loads. The rotor disk can expand because of thermally-induced loads as well as mechanically-induced, centrifugal loads. Thus, a split seal wire will be able to expand and contract during engine operating cycles, producing relative motion against the rotor blade platform while there is contact pressure therebetween. The expansion and contraction produces cyclic rubbing of the seal wire against the platform, in addition to vibratory rubbing motion because of blade platform vibration in a radial direction of the rotor. The relative motion between the rotor blade and the seal wire results in blade platform wear that manifests itself in an irregular wear groove pattern on the inner surface of the blade platform, and such wear results in gaps in the area where the seal wire contacts the blade platforms and rotor disks during engine operation. The formation of such gaps, as a consequence of the resulting enlargement of a portion of the leakage flow passageway resulting from the blade platform wear, leads to increased leakage flow, which can result in diminished engine performance.

It is therefore desirable to provide a blade platform having a seal-wire-contacting surface that is configured to control the seating location of the seal wire, in order to reduce platform wear and maintain blockage of the gas leakage path, to thereby maintain an effective sealing relationship in order to minimize leakage gas flow.

SUMMARY OF THE INVENTION

Briefly stated, in accordance with one aspect of the present invention, a turbomachine rotor blade is provided with at least one seal wire groove. The rotor blade includes a base member having a longitudinal axis and a transverse axis. A platform is carried by the base member and extends generally transversely relative to the longitudinal axis. An airfoil extends in a longitudinal direction from the platform and on a side of the platform opposite from the base member. The platform includes at least one seal wire groove adjacent to the base member, and the seal wire groove is defined by a concave section for receiving a peripheral surface of a seal wire. The seal wire groove also includes a ramp section extending from the concave section and inclined relative to the base member transverse axis to guide movement of the seal wire toward the concave section.

BRIEF DESCRIPTION OF THE DRAWINGS

The structure, operation, and advantages of the present invention will become further apparent upon consideration of the following description, taken in conjunction with the accompanying drawings in which.

DESCRIPTION OF THE PREFERRED EMBODIMENTS

As used herein, the terms "forward" and "upstream," on the one hand, and the terms "aft" and "downstream," on the other hand, are used interchangeably and are intended to indicate positions and directions relative to the principal direction of gas flow over a turbomachine rotor blade airfoil. Thus as will be appreciated by those skilled in the art, in a compressor the forward and upstream positions of a rotor and rotor blade will be at a lower static pressure than the aft and downstream positions. Conversely, in a turbine the forward and upstream positions of a rotor and a rotor blade will be at a higher static pressure than the aft and downstream positions. In either case, however, there is a possibility for leakage flow to occur between the blade base member and the rotor disk, and it is the minimization of such leakage flow to which the present invention is directed.

Also as used herein, the term "split," as applied to the seal wire, refers to a seal wire that is not in the form of a continuous ring or loop, but that has a predetermined length. When installed in a seal wire groove in the rotor disk there is a small circumferential gap between the ends of the seal wire, and that arrangement allows the seal wire to move radially relative to the seal wire groove in the rotor disk during engine operation.

Figure 1:
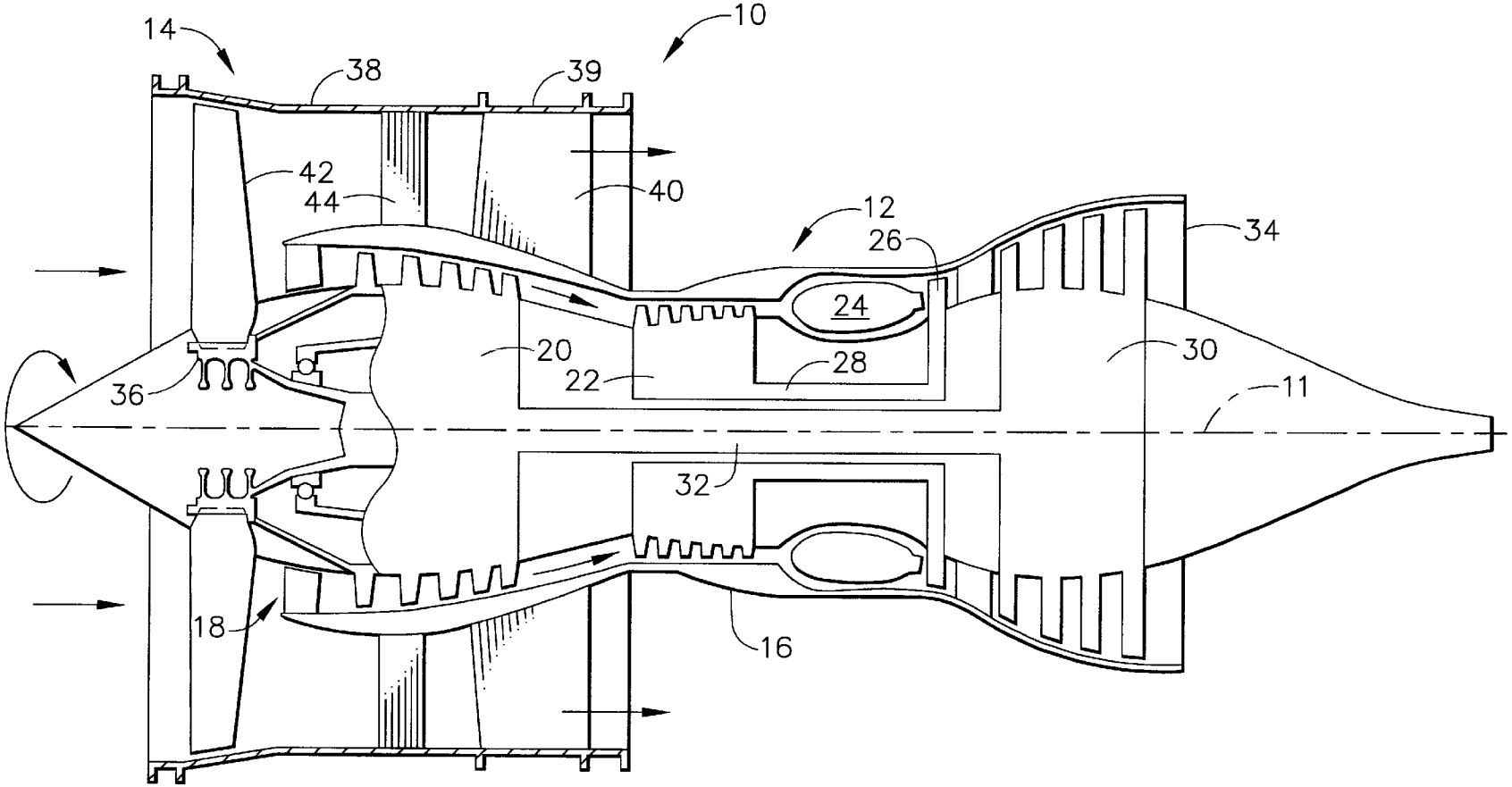
FIG. 1 is a longitudinal, cross-sectional view of one type of aircraft gas turbine engine.

Referring now to the drawings, and particularly to FIG. 1 thereof, there is shown in diagrammatic form an aircraft turbofan engine 10 having a longitudinal axis 11, and including a core gas turbine engine 12 and a fan section 14 positioned upstream of the core engine. Core engine 12 includes a generally tubular outer casing 16 that defines an annular core engine inlet 18. Casing 16 also surrounds a low-pressure booster 20 for raising the pressure of the incoming air to a first pressure level.

A high pressure, multi-stage, axial-flow compressor 22 receives pressurized air from booster 20 and further increases the pressure of the air to a second, higher pressure level. The high pressure air flows to a combustor 24 in which fuel is injected into the pressurized air stream, and the fuel-air mixture is ignited to raise the temperature and energy level of the pressurized air. The high energy combustion products flow to a first turbine 26 for driving compressor 22 through a first drive shaft 28, and then to a second turbine 30 for driving booster 20 through a second drive shaft 32 that is coaxial with first drive shaft 28. After driving each of turbines 26 and 30, the combustion products leave core engine 12 through an exhaust nozzle 34 to provide propulsive jet thrust.

Fan section 14 includes a rotatable, axial-flow fan rotor 36 that is driven by second turbine 30. An annular fan casing 38 surrounds fan rotor 36 and is supported from core engine 12 by a plurality of substantially radially-extending, circumferentially-spaced support struts 44. Fan rotor 36 carries a plurality of radially-extending, circumferentially spaced fan blades 42. Fan casing 38 extends rearwardly from fan rotor 36 over an outer portion of core engine 12 to define a secondary, or bypass airflow conduit. A casing element 39 that is downstream of and connected with fan casing 38 supports a plurality of fan stream outlet guide vanes 40. The air that passes through fan section 14 is propelled in a downstream direction by fan blades 42 to provide additional propulsive thrust to supplement the thrust provided by core engine 12.

Figure 2:
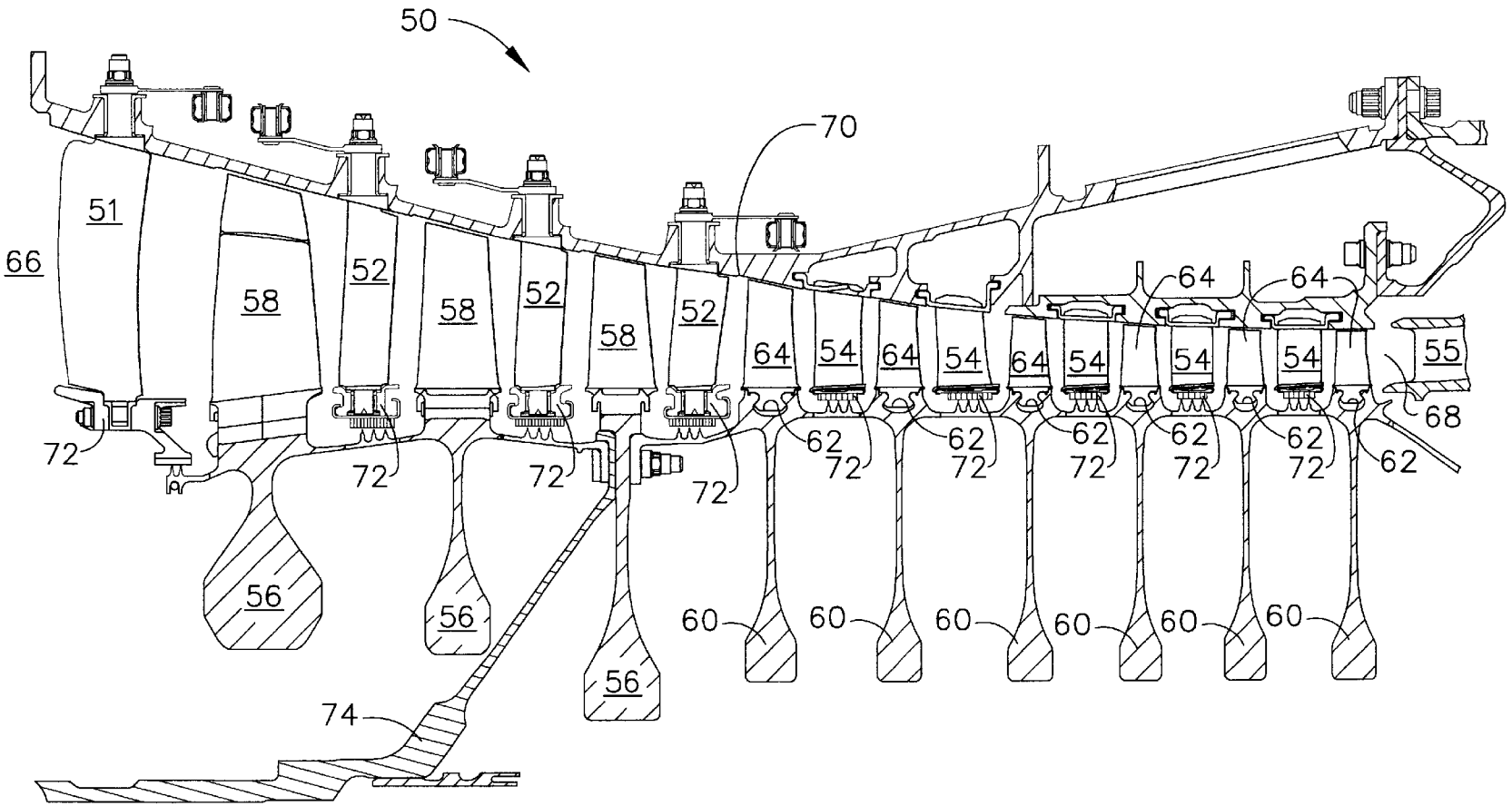
FIG. 2 is a longitudinal, cross-sectional view of one form of turbomachine, in this instance in the form of an axial-flow compressor, in which the present invention can be employed.

FIG. 2 shows one form of axial-flow compressor 50 having 9 stages. Each stage includes an array of radially-extending, circumferentially-spaced stator vanes, adjacent to each of which and on the upstream side is a rotor disk having a plurality of peripherally-carried, radially-extending, circumferentially-spaced rotor blades. Inlet guide vanes 51 and stator vanes 52 of stages 1 through 3 of compressor 50 are variable in that they are pivotable about an axis that extends radially relative to the compressor axis of rotation, whereas stator vanes 54 of stages 4 through 8 and outlet guide vanes 55 are fixed in position. Additionally, in stages 1 through 3 the respective rotor disks 56 have a series of peripherally-spaced, axially-extending dovetail slots into which the rotor blades 58 are inserted and from which the rotor blades are removed in an axial direction. The rotor disks 60 for stages 4 through 9, on the other hand, each have a single, circumferentially-extending dovetail slot 62, into which the rotor blades are inserted in a generally tangential direction relative to the rotor disk.

Compressor 50 includes an inlet 66 defining a flow passageway having a relatively large flow area, and an outlet 68 defining a relatively smaller area flow passageway through which the compressed air passes. The outer wall of the flow passageway is defined by an outer annular casing 70 and the inner wall of the flow passageway is defined by the blade platforms of the respective blades 58, 64 carried by the rotors 56, 60, and also by a stationary annular seal ring 72 carried at the inner periphery of each of the respective stator sections. As shown, the respective rotor disks 56, 60 are ganged together by a suitable disk-to-disk coupling arrangement (not shown), and the third stage disk is connected with a drive shaft 74 that is operatively connected with a turbine rotor (not shown).

Each of the stator sections includes an annular abradable seal that is carried by a respective annular sealing ring 72 and that is adapted to be engaged by respective labyrinth seals carried by the rotors in order to minimize air leakage around the respective stators 52, 54. Sealing rings 72 also serve to confine the flow of air to t he flow passageway defined by outer casing 70 and the radially innermost surfaces of the respective stator vanes.

Figure 3:
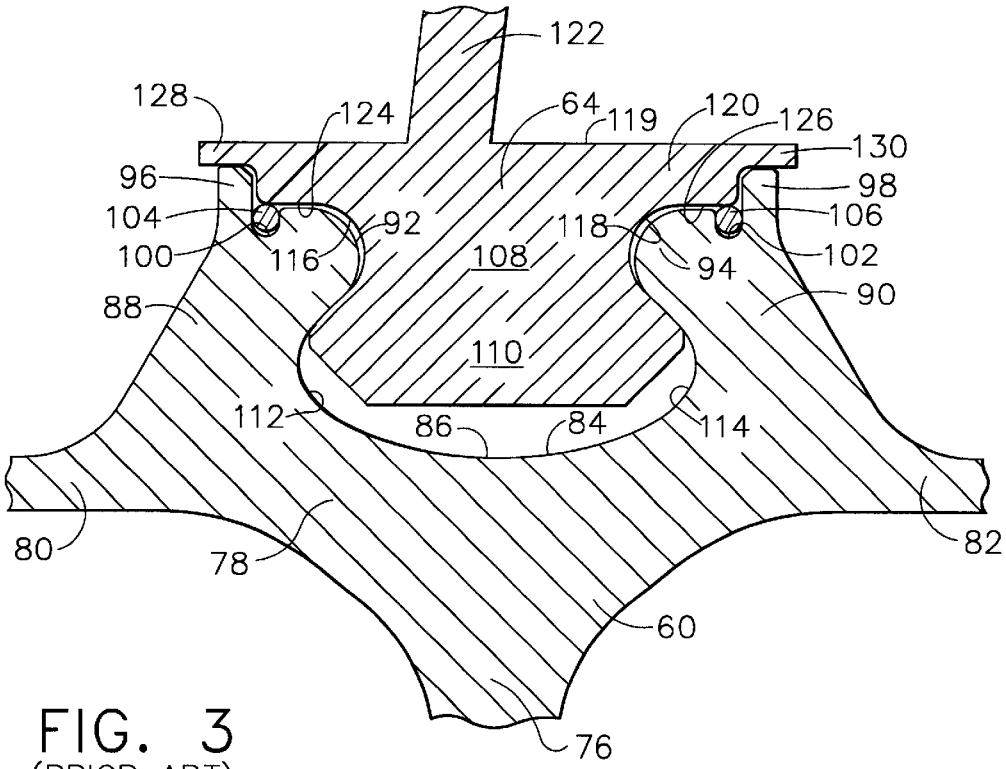
FIG. 3 (PRIOR ART)
FIG. 3 is an enlarged, fragmentary, cross-sectional view showing the interconnection of a rotor blade with a rotor disk for a known blade-to-disk connection arrangement.

Referring no w to FIG. 3, there is shown a connection arrangement between a rotor blade 64 and a rotor disk 60 in a currently-employed blade-to-disk sealing arrangement. Rotor disk 60 includes a plate-like disk body 76 that terminates in an enlarged outer rim 78. Outer rim 78 includes a forward axial ring 80 and an aft axial ring 82 that each extend in a generally axial direction of the engine to engage with corresponding forward and aft axial rings 80, 82 of adjacent rotor disks 60 to provide a direct, driving interconnection between the respective rotor disks so that they all rotate together. Outer rim 78 also includes a rotor-blade-receiving circumferential slot 84 that is of generally U-shaped form. Slot 84 is in the cross-sectional form of a dovetail, and it includes a slot base 86. Slot 84 is defined by a forward sidewall 88 and an aft sidewall 90 that are spaced axially from each other and that extend in a generally radial direction. Each of forward and aft sidewalls 88, 90 has a respective inward convex projection 92, 94 to define the generally dovetail-type shape of the slot. Additionally, each slot sidewall 88, 90 includes a radially-extending flange 96, 98. Positioned between each radial flange 96, 98 and the corresponding inward convex projection 92, 94, there is provided a recessed seal wire groove 100, 102 for receiving a respective seal wire 104, 106 having a substantially circular cross-section. The seal wires are split and have a predetermined length so that they extend substantially completely along the circumferential length of the seal wire grooves. The axial width of each of grooves 100, 102 is selected to slidably receive seal wires 104, 106, and each groove has a depth in the radial direction that is at least as deep as the diameter of a seal wire.

Rotor blade 64 includes a base member 108 that has a shape that corresponds substantially with that of circumferential slot 84. Base member 108 as shown is in the form of a dovetail and includes an enlarged base portion 110 that is received in lateral recesses 112, 114 formed in rotor slot 84. Base member 108 also includes a recessed portion 116, 118 on each side to receive the inwardly-extending convex projections 92, 94 of rotor slot 84. A blade platform 120 is carried on base member 108 and extends in a generally transverse direction relative to the longitudinal axis of the base member. It will be appreciated by those skilled in the art that although shown as having a platform outer surface that is substantially parallel with the axis of rotation of the rotor disk, in actual practice the uppermost surface 119 of blade platform 120 can be inclined relative to the rotor disk rotational axis, with the direction of inclination dependent upon whether the blade and rotor are a part of a compressor or a part of a turbine.

Extending longitudinally from upper surface 119 of blade platform 120, and in a direction opposite to that of base member 108, is an airfoil portion 122, which is adapted to contact the gases that pass through the engine. Platform 120 includes a pair of axially-spaced lower surfaces 124, 126, that each face respective convex projections 92, 94 of rotor disk 60, and that each defines a generally planar surface. Each of lower surfaces 124, 126 also overlies a respective seal wire groove 100, 102 that is formed in rotor disk 60. Blade platform 120 terminates at a forward axial extension 128 and at an aft axial extension 130 that each overlies a respective forward and aft radial flange 96, 98 carried by rotor disk 60.

In the arrangement shown in FIG. 3, seal wires 104, 106 make line contact with the respective platform lower faces 124, 126, and they also make at least line contact with a portion of respective seal wire grooves 100, 102 formed in rotor disk 60. Thus, by virtue of the dual points of line contact provided by the seal wires, with the blade platform and with the rotor disk, a substantially continuous gas leakage flow path that would otherwise exist by virtue of the gap between blade base member 108 and rotor circumferential slot 84 is effectively blocked and closed when the seal wires are in contact with each of those surfaces.

Over time, however, and as a result of movement of the seal wires relative to the blade platform during engine operation, wear can occur at the platform lower faces 124, 126. As a result, the gap between the blade base member, or dovetail, and the rotor disk dovetail slot at the seal wire contact points is enlarged, thereby allowing gas leakage to occur from the high pressure region of the rotor disk to the low pressure region, thereby reducing the operating efficiency of the compressor. Accordingly, to maintain efficient compressor and engine operation the rotor blades having the worn blade platform lower surfaces must be removed and replaced with new blades, thereby causing engine downtime and resulting in undesirable increased engine maintenance and overall engine operating costs.

Figure 4:
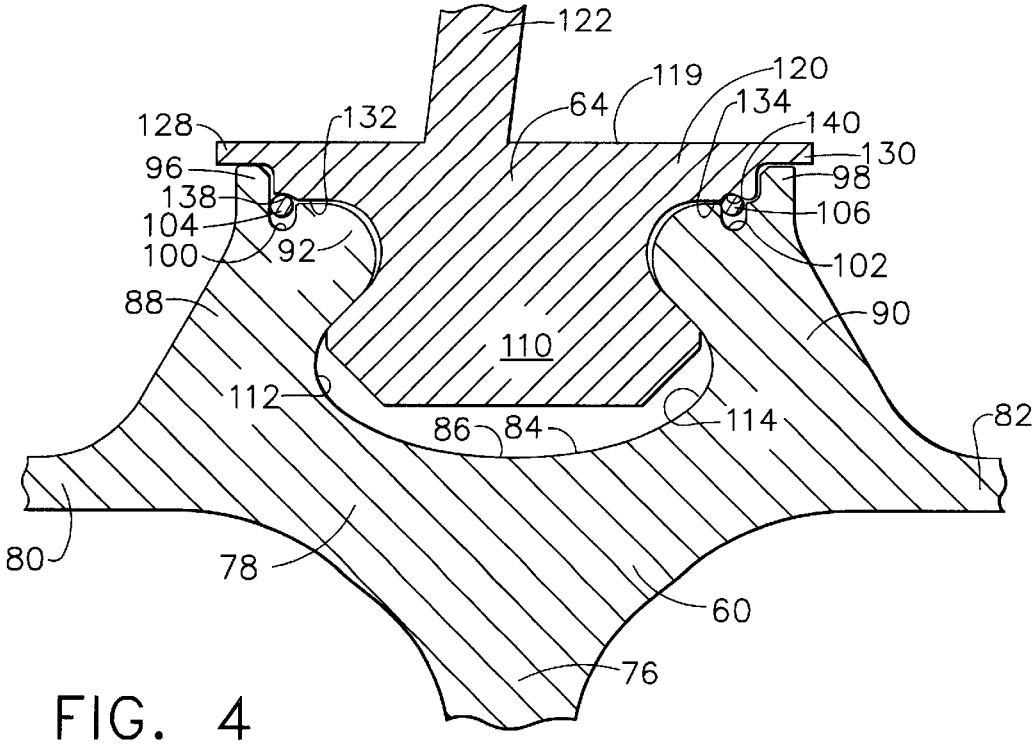
FIG. 4 is an enlarged, fragmentary, cross-sectional view similar to that of FIG. 3, showing an embodiment of an improved blade-to-disk sealing arrangement.

An embodiment of the present invention directed to minimizing blade platform lower surface wear, while maintaining seal integrity, is shown in FIG. 4, wherein similarly-configured elements are identified with the same reference numerals as are utilized in FIG. 3. As can be seen from FIG. 4, the blade platform forward and aft lower surfaces 132, 134 of rotor blade 136 each include a respective concave recess 138, 140 that is axially aligned with corresponding disk groves 100, 102 to receive and to engage with respective seal wires 104, 106. Concave recesses 138, 140 are configured to facilitate surface-to-surface contact between blade platform 142 and seal wires 104, 106, rather than line contact therebetween, thereby reducing the localized compressive stresses to which forward and aft blade platform lower faces 132, 134 are subjected during engine operation.

Figure 5:
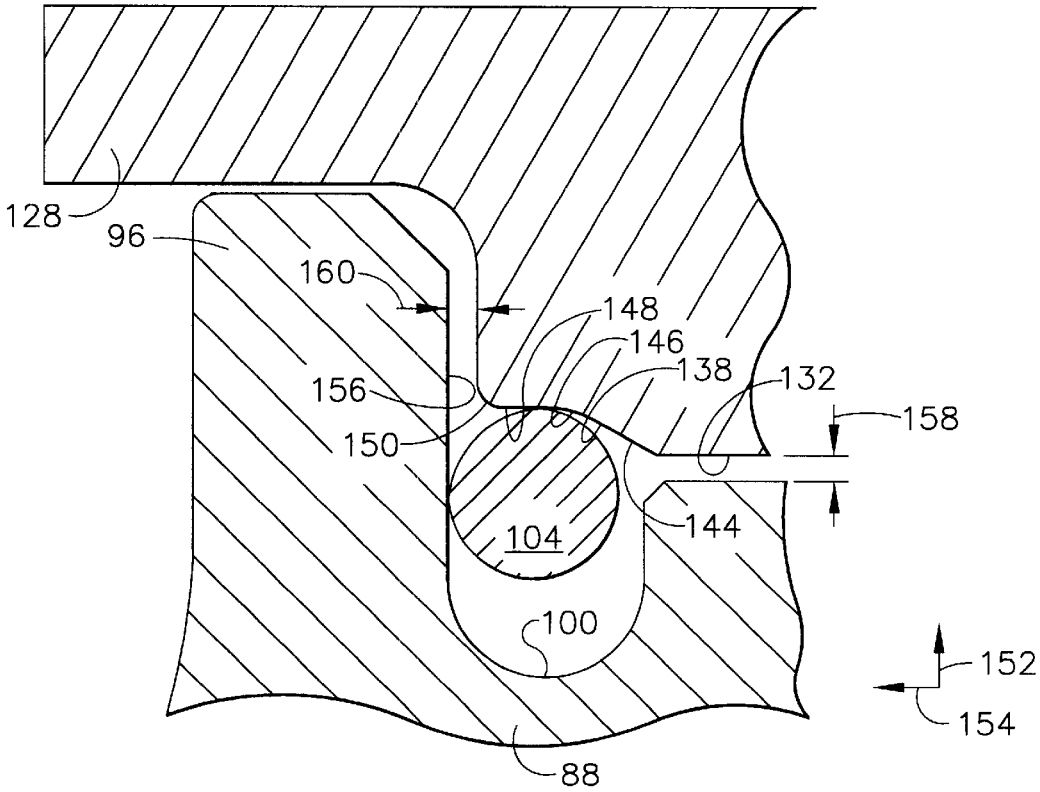
FIG. 5 is a further enlarged, fragmentary, cross-sectional view of the upstream seal shown in FIG. 4.
Figure 6:
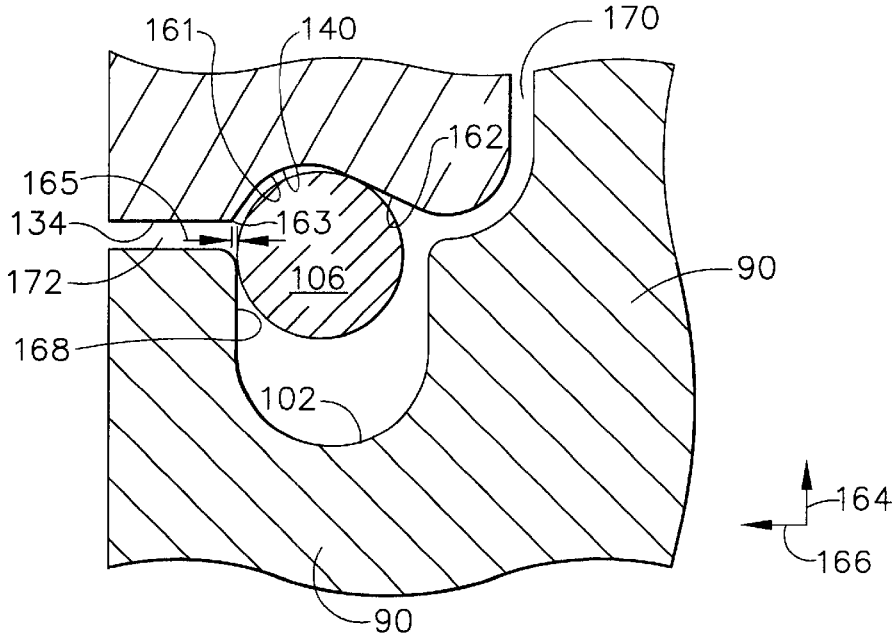
FIG. 6 is a further enlarged, fragmentary, cross-sectional view of the downstream seal shown in FIG. 4.

The configuration of each of platform recesses 138 and 140 is shown in enlarged detail in FIGS. 5 and 6, respectively. FIG. 5 shows forward platform recess 138, which includes an inclined ramp 144 that extends from and that is inclined relative to forward lower face 132. The inclination of ramp 144 has components that extend in a radially outward direction and in a forward axial direction, relative to the rotor disk. Further, the angle of inclination of inclined ramp 144, relative to the rotor axis, can be of the order of about 25°, and can range from an angle of about 20° to about 400. As it is shown in FIG. 5, the angle of inclination of ramp 144 relative to the transverse axis of the blade is about 25°. Additionally, inclined ramp 144 faces in a direction opposite to the direction of the airfoil portion of the blade, and away from the longitudinal access of the base member.

A concave region 146 extends from the forwardmost end of inclined ramp 144 to an axially-extending surface 138. Axial surface 148 extends forwardly to a step 150, from which forward axial extension 128 extends. Axial surface 148 can be parallel to forward lower face 132. Concave region 146 can have an arc length that subtends an angle of from about 15° to about 45°. In that regard, in one embodiment of the invention concave region subtends an arc of about 20°, and is a circular arc having an arc radius that corresponds substantially with the radius of seal wire 104. Additionally, the depth of recess 138, the radial distance between forward lower face 132 and axial surface 148, is less than the radius of seal wire 104.

When the engine is in operation, the centrifugal force acting on seal wire 104 urges it in a radially outward direction, in the direction of arrow 152, against ramp 144. The inclination of ramp 144 causes seal wire 104 to move outwardly and forwardly, along the surface of the ramp, in the directions defined by arrows 152 and 154, respectively, so that the wire moves toward and is seated at concave region 146 to provide a surface-to-surface seal between wire 104 and recess 138. Because the combination of the centrifugal force and the inclination of ramp 144 serves to urge seal wire 104 in a forward axial direction, relative to the rotor disk, the seal wire is also caused to contact radial surface 156 of seal wire groove 100.

Also serving to urge forward seal wire 104 in a forward axial direction is a force that results from the gas pressure differential between the upstream side and the downstream side of the rotor blade. Gas pressure acts against wire 104 because of the pressure differential between the relatively higher pressure of the gas that is present in axial gap 158 between the rotor disk and the blade platform, and the relatively lower pressure of the gas that is present in gap 160 on the upstream side of the seal wire. Accordingly, the gas pressure differential is utilized to aid in maintaining a tight seal between the seal wire and the seal wire groove.

Because of the greater surface contact area that is provided between seal wire 104 and concave region 146 of recess 138, compressive stresses acting at the interface between those elements are at a significantly lower level than they would be if the contact were solely line contact. As a result, wear of the blade platform is significantly reduced, thereby reducing the need for blade replacement as a consequence of wear at the lower face of the blade platform.

FIG. 6 shows platform rear recess 140 in enlarged form. As shown, platform rear recess 140 includes a concave region 161 that extends from aft lower face 134 to an inclined ramp 162. Concave region 160 can have an arc length that subtends an angle of from about 80° to about 135°. As it is shown in FIG. 6, concave region 161 is defined by a circular arc that has a radius that corresponds with the radius of seal wire 106, and that subtends an angle of about 90°. The depth of recess 140 in the radial direction of the rotor disk is less than the radius of curvature of the concave wall and is also less than the radius of curvature of seal wire 106.

Inclined ramp 162 extends from the aft end of concave region 160 to substantially a point that lies on an axial extension of aft lower face 134. The angle of inclination of ramp 162 relative to the transverse axis of the rotor blade an range from an angle of from about 20° to about 40°. As it is shown in FIG. 6, the angle of inclination of ramp 162 is about 32° relative to the transverse axis of the blade. Additionally, inclined ramp 162 faces in a direction opposite to the direction of the airfoil portion of the rotor blade, and toward the longitudinal axis of the base member of the rotor blade.

Because of possible axial misalignment of seal wire groove 102 and concave recess 140 in the fore or aft directions, resulting from tolerance stackup between the platform concave recess 140, wire groove 102, and wall 168, it is desirable to account for such a situation in order to maintain an effective seal to block leakage gas flow. The maximum tolerance stackup can be accommodated by positioning the forwardmost edge 163 of platform concave recess 160 axially forward of groove wall 168 to provide an axial offset 165 therebetween. Providing such an offset will assure contact of seal wire 106 with radial surface 168 and either recess 160 or ramp 162, regardless of the maximum amount of misalignment produced by the stackup of the axial tolerances, even if some wear of the platform caused by the seal wire 106 were to take place.

In operation, the centrifugal force acting on seal wire 106 carried in aft seal wire groove 102 will cause the seal wire to contact the inclined ramp 162. The inclination of ramp 162 causes seal wire 106 to move outwardly and forwardly, along the surface of the ramp, in the directions defined by arrows 164 and 166, respectively, so that the wire moves toward and is seated at concave region 161 to provide a surface-to-surface seal between wire 106 and recess 140. Because the combination of the centrifugal force and the inclination of ramp 162 serves to urge seal wire 106 in a forward axial direction, relative to the rotor disk, the seal wire is also caused to contact radial surface 168 of seal wire groove 102.

The angle of inclination of the ramps can be selected so that the adjacent concave recess has a desired radial depth and axial position to provide the desired effect of forcing the seal wire in a direction so that it blocks the gas leakage path. For a given seal wire diameter that angle is dependent upon the axial space available to provide the ramp and the desired radial depth of the adjacent concave recess. In making that determination the structural integrity of the platform must be maintained. That latter consideration therefore interacts with the ramp angle and the angular arc of the concave recess in order to cause the seal wire to be moved to a position in which it effectively blocks the gas leakage path.

The mathematical solution to those geometric inputs and accompanying space restraints results in a range of the angle of inclination of the ramps of from about 20° to about 40° for typical compressor rotor blades, blade platforms, and rotor disks so that the seal wire effectively blocks the gas leakage path. A minimum ramp angle inclination of about 20° is considered to be adequate to produce sufficiently large forces in the directions of arrows 152, 154 and 164, 166 to urge the seal wire into its sealing position.

Also serving to urge aft seal wire 106 in a forward axial direction is a force that results from the gas pressure differential between the upstream side and the downstream side of the rotor blade. Gas pressure acts against wire 106 because of the pressure differential between the relatively higher pressure of the gas that is present in radial gap 170 between the rotor disk and the blade platform, and the relatively lower pressure of the gas that is present in gap 172 on the upstream side of the seal wire. Accordingly, the gas pressure differential is utilized to aid in maintaining a tight seal between the seal wire and the seal wire groove.

The axial alignment tolerance stackup between the rotor blade platform ramp and the associated recess, relative to the seal wire groove in the rotor disk, can be provided for during manufacture of the rotor blade. During manufacture of such blades the platform features can be automatically incorporated in the dovetail and platform final grinding step, which is performed with a grinding tool that simultaneously forms and finishes the dovetail and platform surfaces in question. The sealing wire recess and ramp are therefore included in the grinding tool configuration, to meet the tight manufacturing axial tolerances required in the dovetail pressure faces, typically 0.0005 inches for such compressor rotor blade dovetails. In addition, by so doing there is no significant additional cost incurred to manufacture the parts having those elements.

Because of the surface-to-surface contact that is provided between seal wire 106 and concave region 161 of recess 140, compressive stresses acting at the interface between those elements are at a significantly lower level than they would be if the contact were solely line contact. As a result, wear of the blade platforms is significantly reduced, thereby reducing the need for blade replacement as a consequence of wear at the lower face of the blade platform.

Accordingly, it will be apparent to those skilled in the art that the disclosed arrangement minimizes cross-stage leakage flow of gas across the upstream and downstream sides of the turbomachine rotor and between the blade platform and the rotor disk. Moreover, the provision of surface-to-surface contact between the seal wire and the corresponding recess provided in the platform will reduce the contact stress between the seal wire and the blade platform, thereby reducing platform wear caused by movement of the seal wire toward and away from the platform. As s result, the need for blade replacement as a consequence of platform wear can be significantly reduced, thereby extending engine operating life between blade replacements.

As to both the forward and aft seal wires, the inclined ramps serve as guide surfaces along which the seal wires can move toward the concave portions of the seal wire recesses. And the concave recesses serve to hold the seal wire in a predetermined position, thereby minimizing fore-and-aft movement of the seal wire, thereby reducing the tendency for wear on the underside of the blade platform.

Although particular embodiments of the present invention have been illustrated and described, it would be apparent to those skilled in the art that various changes and modifications can be made without departing from the spirit of the present invention. Accordingly, it is intended to encompass within the appended claims all such changes and modifications that fall within the scope of the present invention.

What is claimed is:

1. A turbomachine rotor blade comprising: a base member having a longitudinal axis and a transverse axis; a platform carried by the base member and extending generally transversely relative to the longitudinal axis; and an airfoil extending in a longitudinal direction from the platform and on a side of the platform opposite from the base member; wherein the platform includes at least one seal wire recess adjacent the base member and defined by a concave section for receiving a peripheral surface of a seal wire, and a ramp section extending from the concave section and inclined relative to the base member transverse axis to guide movement of a seal wire toward the concave section.

2. A turbomachine rotor blade in accordance with claim 1, wherein the angle of inclination of the ramp section relative to the transverse axis is from about 15° to about 45°.

3. A turbomachine rotor blade in accordance with claim 2, wherein the ramp section faces in a direction opposite from the airfoil.

4. A turbomachine rotor blade in accordance with claim 3, wherein the ramp section faces away from the base member.

5. A turbomachine rotor blade in accordance with claim 4, wherein the ramp section lies inwardly of the concave section, relative to the longitudinal axis.

6. A turbomachine rotor blade in accordance with claim 3, wherein the ramp section faces toward the base member.

7. A turbomachine rotor blade in accordance with claim 6, wherein the ramp section lies outwardly of the concave section, relative to the longitudinal axis.

8. A turbomachine rotor blade in accordance with claim 3, wherein the ramp section faces in an upstream direction relative to a principal direction of gas flow over the airfoil.

9. A turbomachine rotor blade in accordance with claim 2, wherein the rotor blade includes a pair of seal wire recesses that are carried on respective opposite sides of the longitudinal axis, wherein each of a first seal wire recess and a second seal wire recess includes a ramp section having an angle of inclination of from about 20° to about 40° relative to the transverse axis, and wherein the first seal wire recess ramp section faces away from the base member and the second seal wire recess ramp section faces toward the base member.

10. A turbomachine rotor blade in accordance with claim 9, wherein the seal wire grooves are substantially parallel to each other.

11. A turbomachine rotor blade in accordance with claim 10, wherein the first seal wire recess is on an upstream side of the blade and the second seal wire recess is on the downstream side of the blade.

12. A turbomachine rotor blade in accordance with claim 1, wherein the angle of inclination of the ramp section relative to the transverse axis is about 32°.

13. A turbomachine rotor blade in accordance with claim 12, wherein the ramp section faces in a direction opposite from the airfoil.

14. A turbomachine rotor blade in accordance with claim 1, wherein the angle of inclination of the ramp section relative to the transverse axis is about 25°.

15. A turbomachine rotor blade in accordance with claim 14, wherein the ramp section faces in a direction opposite from the airfoil.

16. A turbomachine rotor blade in accordance with claim 1, wherein the concave section subtends an arc from about 10° to about 135°.

17. A turbomachine rotor blade in accordance with claim 1, wherein the concave section subtends an arc of about 20°.

18. A turbomachine rotor blade in accordance with claim 1, wherein the concave section subtends an arc of about 90°.

19. A turbomachine rotor blade in accordance with claim 1, wherein the concave section is defined by a substantially circular arc having a predetermined radius.

20. A turbomachine rotor blade in accordance with claim 19, wherein the concave section has a depth less than the predetermined radius.

* * * * *